US009038696B2

(12) United States Patent
Lava et al.

(10) Patent No.: US 9,038,696 B2
(45) Date of Patent: May 26, 2015

(54) BLIND ADJUSTER

(76) Inventors: Aaron Lava, Greenvale (AU); Joel Lava, Greenvale (AU)

( * ) Notice: Subject to any disclaimer, the term of this patent is extended or adjusted under 35 U.S.C. 154(b) by 0 days.

(21) Appl. No.: 13/695,365

(22) PCT Filed: May 2, 2011

(86) PCT No.: PCT/AU2011/000499

§ 371 (c)(1),
(2), (4) Date: Dec. 11, 2012

(87) PCT Pub. No.: WO2011/134022

PCT Pub. Date: Nov. 3, 2011

(65) Prior Publication Data

US 2013/0068405 A1 Mar. 21, 2013

(30) Foreign Application Priority Data

Apr. 30, 2010 (AU) ..... 2010901847

(51) Int. Cl.
*A47H 1/00* (2006.01)
*E06B 9/42* (2006.01)
(Continued)

(52) U.S. Cl.
CPC ... *E06B 9/42* (2013.01); *E06B 9/40* (2013.01); *E06B 9/326* (2013.01); *E06B 9/78* (2013.01); *E06B 2009/905* (2013.01); *E06B 9/56* (2013.01)

(58) Field of Classification Search
USPC ..... 160/320, 321, 322, 193; 474/136
IPC ..... E06B 9/40,9/42, 9/80
See application file for complete search history.

(56) References Cited

U.S. PATENT DOCUMENTS 2,237,850 A * 4/1941 Stobie ..... 160/172 R
3,022,819 A * 2/1962 Lampret ..... 160/345
(Continued)

FOREIGN PATENT DOCUMENTS

CN 2868099 Y 2/2007
DE 202009016013 U1 3/2010
(Continued)

OTHER PUBLICATIONS

Lava, Aaron, et al., Australian Patent Application No. 2010901847, International-Type Search Report, Jul. 22, 2010.
(Continued)

*Primary Examiner* — Blair M Johnson
(74) *Attorney, Agent, or Firm* — Michael G. Johnston; Moore & Van Allen PLLC

(57) ABSTRACT

A mechanism for controlling adjustment of a blind or the like, the mechanism including, a fixable member which in use is fixed in position relative to the blind, a rotatable member located proximate the fixable member being rotatable relative to the fixable member about an axis of rotation to adjust the blind, an elongate member a proximal end of which is located proximate the rotatable member, the elongate member having a longitudinal axis that intersects the axis of rotation, and a continuous pull element which interacts with the rotatable member, the pull element is movable relative to the fixable member to rotate the rotatable member, the pull element is arranged relative to the elongate member extending from the rotatable member towards a distal end of the elongate member and back towards the rotatable member so as to limit movement of the pull element in a direction substantially perpendicular to the longitudinal axis of the elongate member.

15 Claims, 6 Drawing Sheets

(51) Int. Cl.

| | |
|---|---|
| ***E06B 9/78*** | (2006.01) |
| ***E06B 9/56*** | (2006.01) |
| *E06B 9/40* | (2006.01) |
| *E06B 9/326* | (2006.01) |
| *E06B 9/90* | (2006.01) |

(56) References Cited

U.S. PATENT DOCUMENTS

| | | | | |
|---|---|---|---|---|
| 4,865,109 | A * | 9/1989 | Sherman | 160/321 |
| 5,671,793 | A | 9/1997 | Lee | |
| 5,752,558 | A * | 5/1998 | Lin | 160/320 |
| 5,797,441 | A * | 8/1998 | Benthin | 160/173 V |
| 6,189,595 | B1 * | 2/2001 | Lee | 160/168.1 R |
| 6,196,293 | B1 * | 3/2001 | Lee | 160/168.1 V |
| 7,114,544 | B2 * | 10/2006 | Rice et al. | 160/178.1 V |
| 8,286,686 | B2 * | 10/2012 | Cannaverde | 160/320 |
| 2011/0036517 | A1 | 2/2011 | Chen | |
| 2013/0068405 | A1 * | 3/2013 | Lava et al. | 160/321 |

FOREIGN PATENT DOCUMENTS

| | | | |
|---|---|---|---|
| EP | 1698756 | A1 | 9/2006 |
| NL | 1032895 | C2 | 12/2007 |

OTHER PUBLICATIONS

Lava, Aaron, et al., International Patent Application No. PCT/AU2011/000499, International Search Report, May 31, 2011.

* cited by examiner

BLIND ADJUSTER

This invention relates to a mechanism for controlling adjustment of a blind. The mechanism has been developed for controlling adjustment of a clutch roller blind and it will be convenient to hereinafter describe the invention with reference to this particular application. It ought to be appreciated however that the mechanism is applicable to other blind and curtain control mechanisms where a pull element, such as a chain or cord, is used. These blinds can include venetian and vertical.

A blind generally includes a length of flexible material that can be positioned adjacent a window or the like. A roller blind generally includes a mechanism is used to adjust the position of the material relative to the window. The mechanism includes a cylinder onto which the material is wound, and the cylinder is supported at its distal ends. A clutch roller mechanism includes pull element, such as a chain or cord, located at a distal end of the cylinder. The clutch is normally in an engaged condition whereby it prevents rotation of the cylinder. Pulling on the cord adjusts the condition of the clutch to a disengaged condition so as to allow the cylinder to rotate.

The blinds in general and the cord in particular are intriguing to young children who like to play games using the blind. They like to feel the blind moving over their face as they move through the blind. This can be dangerous for a number of reasons including where they get their heads caught in the loop of the cord. This can result in strangling of the child.

It would be preferable to provide a mechanism for controlling a blind that provided access to the cord to allow operation of the blind while minimising the risk of it being caught around the neck of a child.

A reference herein to a patent document or other matter which is given as prior art is not to be taken as an admission that that document or matter was, in Australia, known or that the information it contains was part of the common general knowledge as at the priority date of any of the claims.

According to this invention there is provided a mechanism for controlling adjustment of a blind or the like, the mechanism including, a fixable member which in use is fixed in position relative to the blind, a rotatable member located proximate the fixable member being rotatable relative to the fixable member about an axis of rotation to adjust the blind, an elongate member having a proximal end which is located proximate the rotatable member, the elongate member having a longitudinal axis, and a continuous pull element which interacts with the rotatable member, the pull element being movable relative to the fixable member to rotate the rotatable member, the pull element being arranged relative to the elongate member extending from the rotatable member towards a distal end of the elongate member and back towards the rotatable member such that movement of the pull element in a direction substantially perpendicular to the longitudinal axis of the elongate member is limited.

It is preferred that the mechanism include biasing means for urging the distal end of the elongate member away from the fixable member so as to apply tension to the pull element. It is further preferred that the elongate member is connected to the fixable member to allow the elongate member to pivot about the axis of rotation, relative to the fixable member. It is still further preferred that the connection is configured to limit pivoting of the elongate member to no more than 90° from a normal operating position. It is also preferred that the pull element is a continuous chain. It is also preferred that the rotatable member is a pulley.

It is preferred that the mechanism include a guide located at the distal end of the elongate member around which the pull element passes. It is preferred that the guide is a pulley that rotates as the pull element is moved.

It is preferred that the mechanism include a housing which houses the rotatable member, the housing includes a sleeve to accommodate the proximal end of the elongate member. Preferably the sleeve is hinged relative to the fixed member so as to allow the elongate member to be movable relative to the axis of rotation. Preferably the sleeve is hinged such that the elongate member is capable of pivoting relative to the fixed member in a plane in which the axis of rotation lies, i.e. the elongate member may be pivoted in a direction such that its longitudinal axis approaches being parallel to the axis of rotation. In practice, this means that the elongate member may be folded such that it lies against a blind to which the mechanism is attached for convenient packaging and installation. It is further preferred that the housing includes an abutment against which the biasing means abuts, and the proximal end of the elongate member also abuts against the abutment to limit movement of the elongate member along its longitudinal axis, i.e. its movement towards the fixable and rotatable members is limited. It is preferred that the biasing means is a compression spring. In this way, the ability for slack to form in the pull element along the elongate member is curtailed.

It is preferred that the fixable member includes a fixed shaft having a longitudinal axis that is coincident with the axis of rotation.

It is also preferred that the longitudinal axis of the elongate member intersects the axis of rotation of the rotatable member when the elongate member is in a normal operating position.

It is preferred that the mechanism include a cylinder for carrying a blind which is rotatable on rotation of the rotatable member.

It is preferred that the mechanism include a driven member interacting with the rotatable member and a clutch interacting with the fixable member and the driven member, wherein the clutch adopts a disengaged condition when the rotatable member is rotated so as to allow rotation of the driven member, and adopts an engaged condition upon cessation of rotation of the rotatable member to prevent further rotation of the driven member. It is further preferred that the driven member is mounted on the rotatable member. It is still further preferred that member includes a barrel portion, and the clutch includes at least one helical spring associated with the fixable member, the helical spring being substantially coaxial with the axis of rotation, the helical spring including a protrusion at each end of the spring extending radially of the axis of rotation, whereby the protrusions are engaged by the barrel portion to expand the helical spring when adopting the disengaged condition. It is preferred that the driven member includes a rib that engages the protrusion on the helical spring to urge the helical spring to contract when adopting the engaged condition. It is further preferred that the at least one helical spring includes two helical springs, whereby the protrusions at one end of each spring are substantially longitudinally aligned, and the protrusions at an opposing end of each spring are also substantially longitudinally aligned.

It will be convenient to hereinafter describe the invention with reference to the accompanying drawings which illustrate one preferred embodiment of the invention. The specifics of the illustrations and detailed description is not intended to limit the broad definition of the invention as herein before described.

Figure 1:
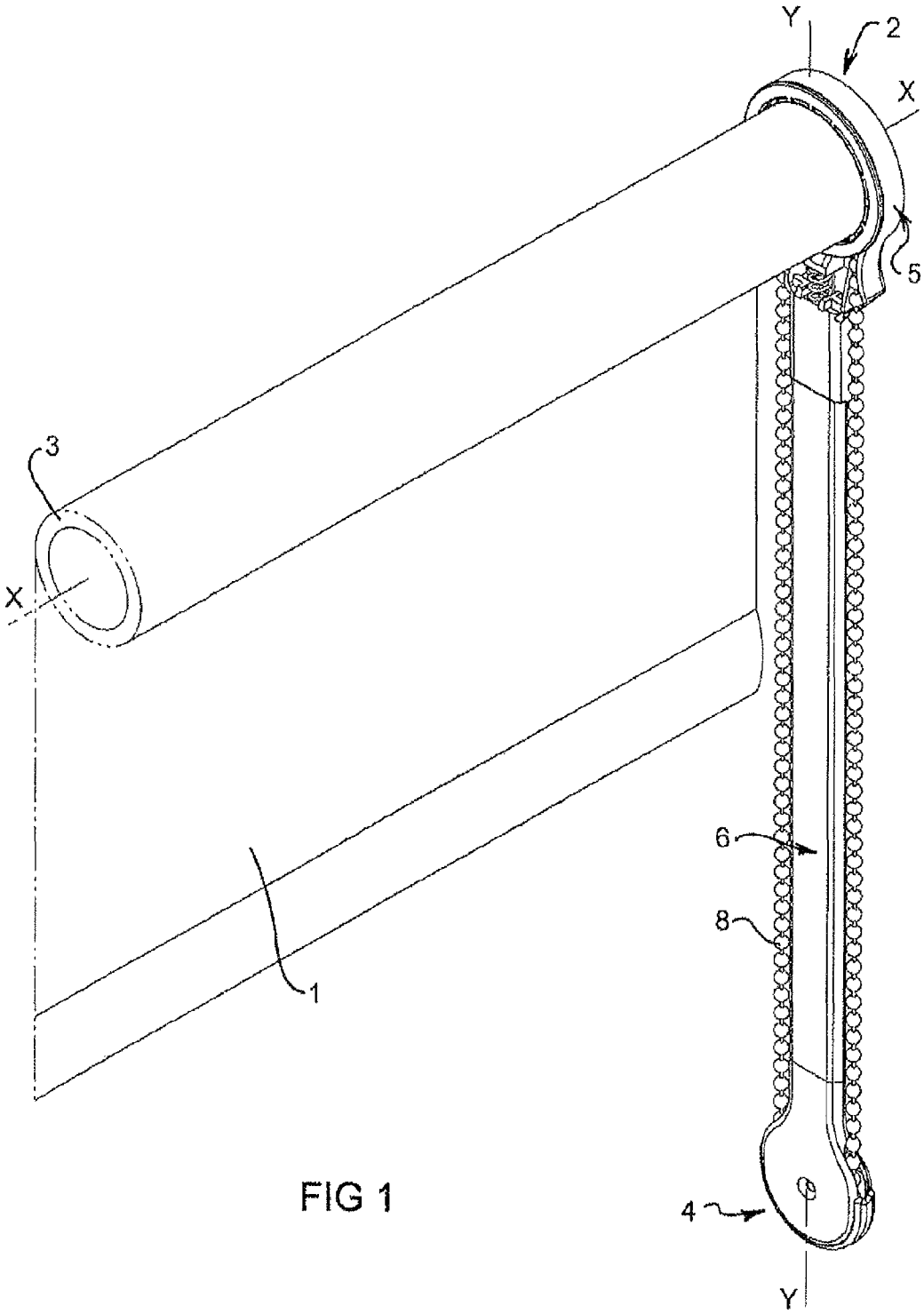
FIG. 1 is an isometric view of a preferred embodiment of the mechanism of the invention in conjunction with part of a blind with the elongate member in a normal (both geometrically and functionally) operating position.

FIG. 1 illustrates a blind 1 and a mechanism 2 for controlling adjustment of the blind 1. More specifically the mechanism 2 controls movement of the blind 1 onto and off a cylinder 3 for the purpose of opening or closing the blind 1 over a window or the like. It ought to be appreciated that the invention is not limited to mechanisms which only make this form of adjustment, and that the invention may also be suitable for use with mechanisms which make other forms of adjustment. One other form of adjustment could be for example the adjustment of the rotational orientation of vertical blinds, or the extension and retraction of a vertical blind or curtain along a track.

The mechanism illustrated in FIG. 1 includes a lower portion 4 and an upper portion 5 which is spaced from the lower portion 4 by an elongate member 6. The upper portion 5 includes the cylinder 3 which is rotatable about an axis XX of rotation. The elongate member 6 has a longitudinal axis YY which intersects the axis XX when the elongate member 6 is in a normal operating position as shown. FIG. 1 illustrates the elongate member 6 in the form of a flat bar however it ought to be appreciated that the elongate member 6 may take other forms, and is not limited to the bar as illustrated. The mechanism illustrated also includes a continuous pull element 8 extending between the upper portion 5 and the lower portion 4 along either side of the elongate member 6. The embodiment illustrated shows the pull element 8 in the form of a chain commonly used with blinds for windows, however this may be replaced by a cord or the like.

Figure 2:
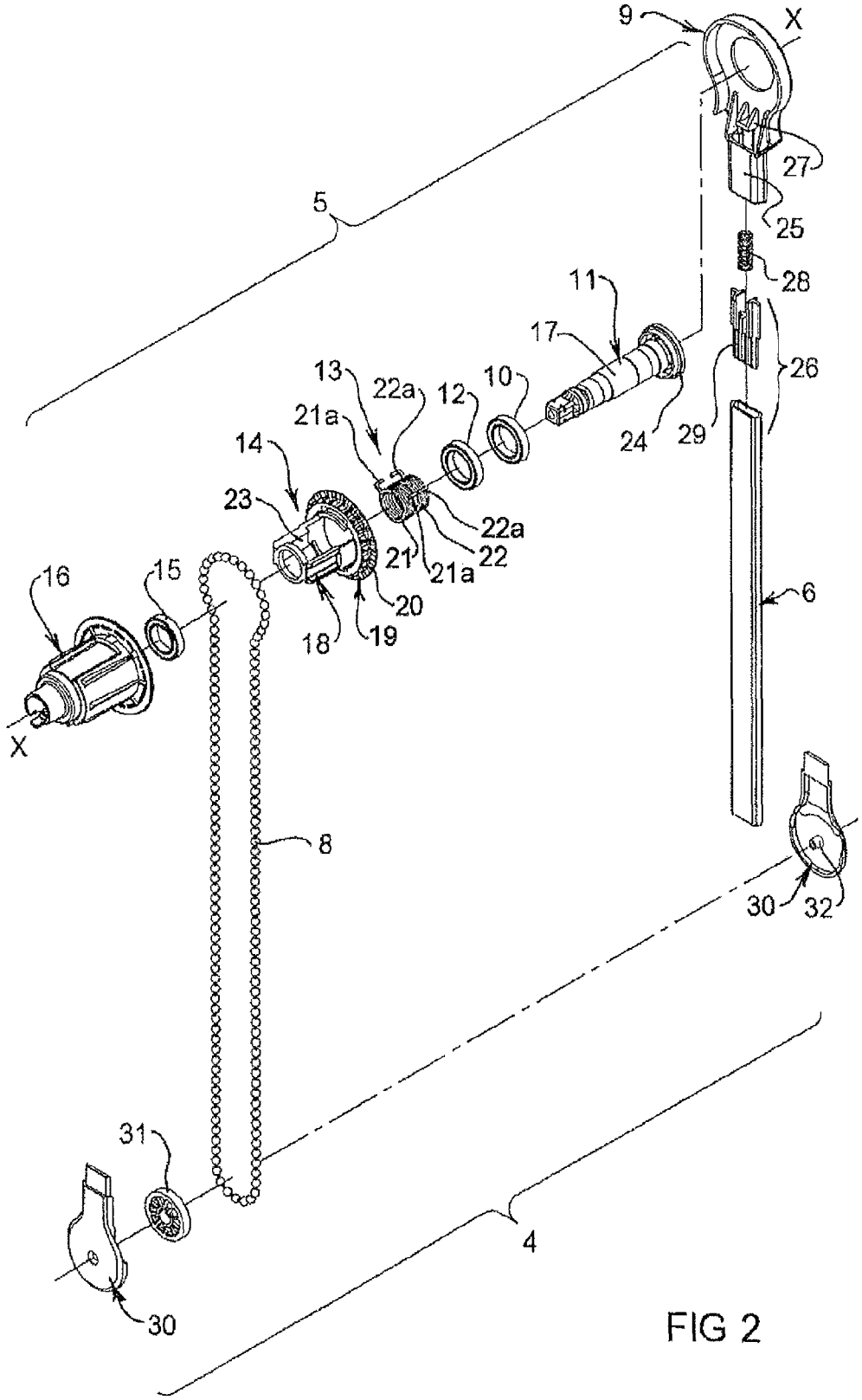
FIG. 2 is an isometric exploded view of the mechanism from FIG. 1.

Referring now to FIG. 2 which illustrates the mechanism in greater detail and revealing the upper portion 5 to include, in summary from right to left, a housing 9, a fixable member 11, a first bearing 10, a second bearing 12, a clutch 13, a rotatable member 14, a third bearing 15, and a driven member 16. The fixable member 11 is normally fixed in position adjacent a window by a bracket (not shown), which is fixed to the wall or a pelmet adjacent the window. The fixable member 11 includes a shaft 17 that is fixed from rotating when connected to the bracket. The shaft 17 has a longitudinal axis which is coincident with the axis XX of rotation. The shaft 17 provides support for the second bearing 12 and the rotatable member 14 so as to allow the rotatable member 14 to rotate about the shaft 17.

The rotatable member 14 includes a barrel portion 18 and a pulley portion 19. The barrel portion 14 is supported on the shaft 17 by the first bearing 10 and the second bearing 12. The pulley portion illustrated in FIG. 2 includes a plurality of dimples 20 which are spaced around a circumference of the pulley portion 19. The dimples act as a sprocket to enable a positive engagement by the balls of the chain 8 so that pulling on the chain 8 results in a direct rotation of the rotatable member 14 about the axis XX of rotation. Naturally if the pull element 8 was in the form of a cord the pulley portion 19 need not include the dimpled surface. Instead the pulley may take the form of a V pulley. Whether the pull element 8 is a chain or a cord or any other arrangement, it is highly desirable that it is relatively inextensible along its length, i.e. it does not stretch.

The shaft 17 of the fixable member 11 also provides support for the clutch 13. The preferred clutch illustrated is in the form of a pair of helical springs 21, 22 with each helical spring 21, 22 having a protrusion 21*a*, 21*b*, 22*a*, 22*b* at each end of the respective springs 21, 22. Each protrusion 21*a*, 22*a*, 21*b*, 22*b* extends radially of the shaft 17 and locates within a slot 23 formed in the barrel portion 18 of the rotatable member 14. The helical springs 21, 22 and the barrel portion 18 interact so that when the chain is pulled, the springs 21, 22 are urged to expand radially and allow the rotatable member 14 to rotate about the shaft 17. Furthermore the helical springs contract when the chain is not pulled so as to grip the shaft. With the protrusions 21*a*, 21*b*, 22*a* or 22*b* presenting a barrier to rotation of the rotatable member 14 by urging on the driven member 16. It should also be noted that whilst a single helical spring would suffice, it is preferable to include a pair of helical springs namely a right hand helical spring and a left hand helical spring. This combination of a right handed and left handed helical spring can counteract the tendency of the driven member to rotate either clockwise or anti-clockwise depending on the way in which the blind has been wound on to the cylinder.

The shaft 17 also supports the third bearing 15 which in turn supports the driven member 16. The driven member 16 is located on the barrel portion 18 and interacts with the rotatable member 14 and the cylinder 3 (see FIG. 1). Rotation of the rotatable member 14 rotates the driven member 16, however the driven member 16 is restrained from rotating independently of the rotatable member 14. The driven member includes a rib (obscured), formed on its inner surface that locates within the slot 23 of the barrel portion 18. The rib interacts with the helical springs 21, 22 so that a direct force on the driven member 16, as a result of for example the weight of the blind 1 urging the cylinder 3 to rotate, causes one of the helical springs 2 to grip the shaft. With the blind wound on to the cylinder as illustrated in FIG. 1, the weight of the blind will urge the cylinder to rotate in an anti-clockwise direction as viewed from the free end illustrated in FIG. 1. The weight of the blind will be counter-balanced by the spring 21, and in particular protrusion 21*a* which will urge the spring to contract and grip the shaft 17. Accordingly, this arrangement limits movement of the driven member 16 by rotation of the rotatable member 4 only.

A boss portion 24 of the fixable member 11 interacts with the housing 9 so as to centrally locate the fixable member 11 relative to the housing 9. The housing 9 includes a centrally located aperture to accommodate the boss portion 24. In this embodiment, the housing 9 may be rotatable relative to the boss portion 24, however it is preferred that rotation be limited to no more than 90°. The boss portion 24 and housing 9 may include a lug and stop arrangement (not shown) to limit the rotation. More specifically when the mechanism 2 is installed it is preferred that the housing 9 be rotatable to 45° either side of the vertical. This will allow the elongate member 6 to pivot out from the window to allow a user to access the pull element 8 more easily. The housing 9 also is shaped to accommodate the plate portion 24 so that the axis YY of the elongate member 6 will still intersect the axis XX, while the housing 9 rotates relative to the plate portion 24. The housing 9 includes a sleeve 25 which accommodates a proximal end 26 of the elongate member 6. The sleeve 25 need not entirely surround the proximal end 26 of the elongate member 6, so long as the sleeve provides a guide or passage for movement of the elongate member towards and away from the axis XX. The elongate member 6 illustrated includes a capping 29 which is also located within the sleeve 25 of the housing 9 when the mechanism is assembled. The housing 9 also includes an abutment 27 which interacts with a biasing means 28, illustrated in the form of a compression spring, acting between the abutment 27 and the capping 29 to urge the elongate member 6 away from the housing 9.

The pull element 8 is arranged so as to extend from the rotatable member 14 towards a distal end of the elongate member 6, such that movement of the pull element 8 in a direction substantially perpendicular to the longitudinal axis of the elongate member 6 is limited. It is preferred that the pull element 8 interact with the distal end of the elongate member 6 so as to maintain tension on the pull element 8. This may be achieved in any suitable manner, however in the embodiment illustrated in FIG. 2 the pull element interacts with a lower portion 4 of the mechanism 2 forming the distal end of the elongate member 6. The lower portion 4 includes a housing 30 which in the embodiment illustrated is in the form of two pieces. The housing 30 could alternatively be formed integrally with the rest of the elongate member 6. The housing 30 houses a guide 31 which in the embodiment illustrated in FIG. 2 is in the form of a pulley 31. The pulley 31 guides the pull element 8 around the distal end of the elongate member 6 and back to the rotatable member. The pulley 31 locates on a shaft 32 formed on the housing 30 so as to allow the pulley 31 to rotate upon movement of the pull element 8 through the housing 30 to minimise friction. The guide 31 could be in the form a shaft that does not rotate, particularly if the pull element 8 was in the form of a cord, provided that this, or any other alternative arrangement does not allow slack to form in the pull element.

Figure 3:
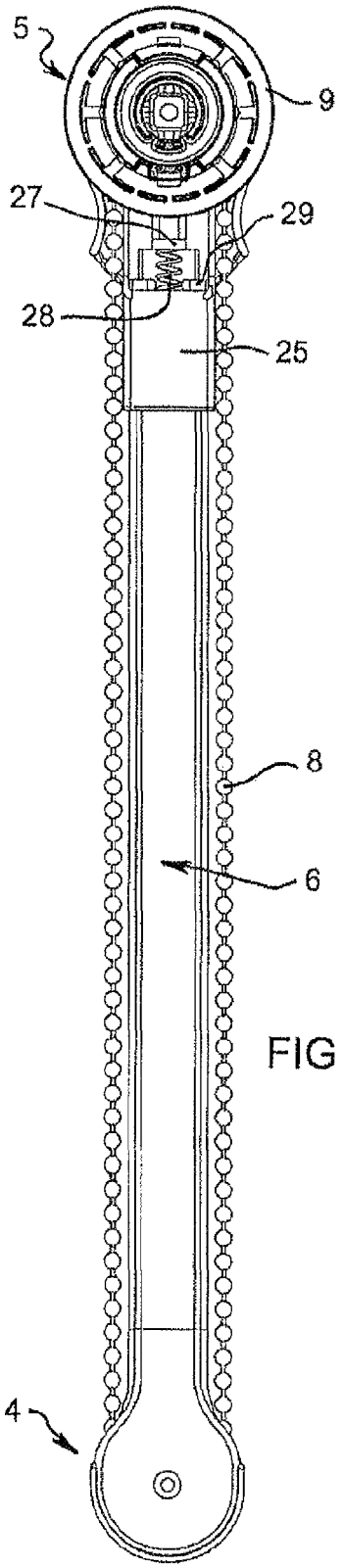
FIG. 3 is a side elevation view of the mechanism from FIG. 1 with the blind removed.
Figure 4:
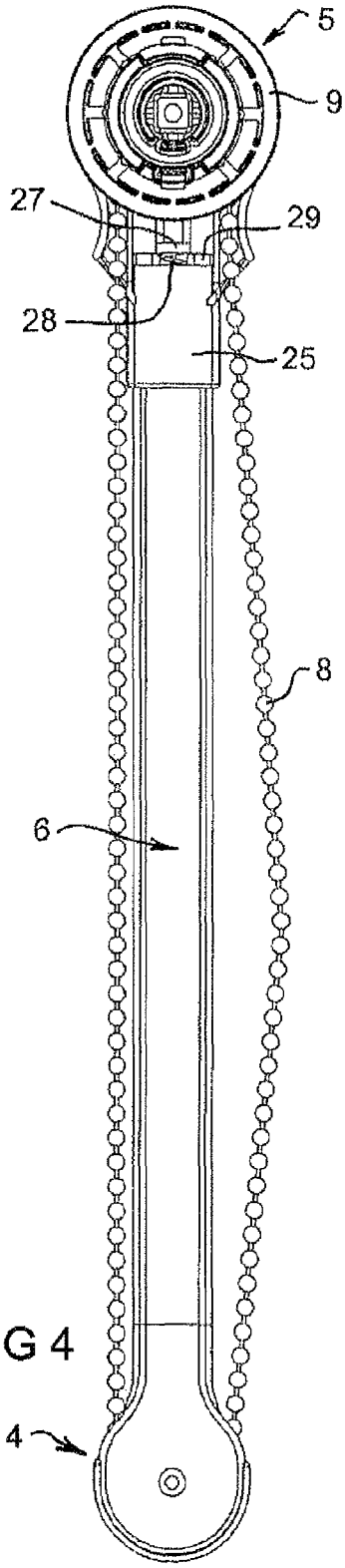
FIG. 4 is the side elevation view of the mechanism from FIG. 3 with the chain pulled laterally of the shaft.

Referring now to FIGS. 3 and 4 which illustrate a front elevation view of the mechanism from FIG. 2 in an assembled form and it can be noted that FIG. 4 illustrates the pull element 8 displaced laterally of the elongate member 6. This causes the elongate member 6 to slide within the sleeve 25 with the cap 29 compressing the spring 28 against the abutment 27 of the housing 9. The cap 29 in turn abuts the abutment 27 to limit the movement of the elongate member 6 towards the housing 9, thereby limiting the ability of the pull element 8 to be displaced perpendicularly to the longitudinal axis YY of the elongate member 6. The pull element 8 only needs to be able to be displaced so as to enable it to be located over the return pulley 31 in the lower portion of the mechanism 4. A displacement of the pull element 8 in the range of 5 to 10 cm has found to be adequate to enable the pull element 8 to be fitted over the pulley 31. Furthermore, by limiting this movement reduces the ability for an infant to squeeze their head between the chain 8 and the elongate member 6. Preferably the allowable displacement of the pull element 8 laterally from the elongate member 6, i.e., the largest diameter sphere which can fit between the elongate element 6 and the pull element 8, is no greater than 10 cm.

Figure 5:
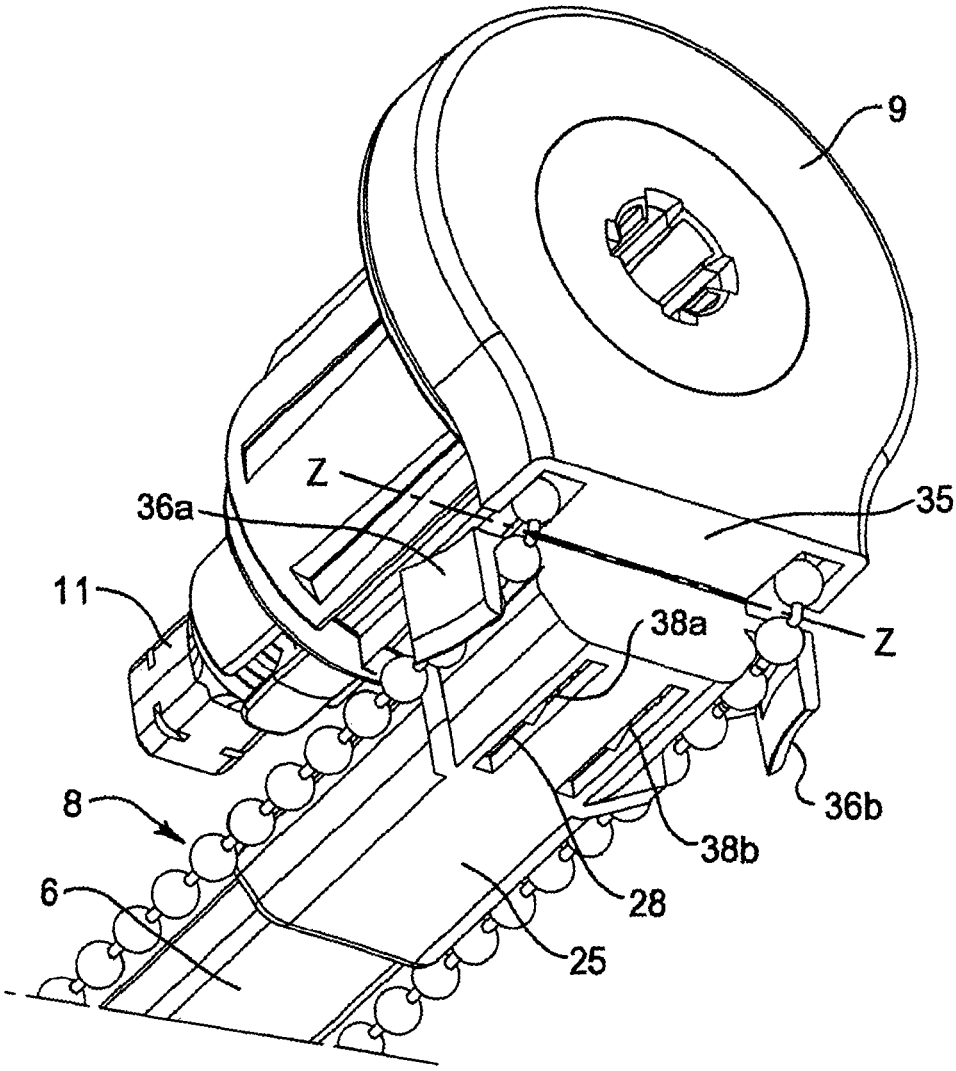
FIG. 5 is an isometric close-up view of another embodiment of the mechanism showing the elongate member in an inwardly folded position.

In FIG. 5 elongate member 6 is shown hinged or folded such that its longitudinal axis YY approaches being parallel with the axis XX (the axes corresponding to those described in relation to FIG. 1). In this embodiment, a hinge 35 is present between housing 9 and sleeve 25 which allows elongate member 6 to pivot relative to fixable member 11 (partly shown) about an axis of rotation ZZ. Guides 36*a* and 36*b* ensure that pull element 8 is not allowed to develop any significant slack when the elongate member 6 is so pivoted. When elongate member is pivoted as shown in FIG. 5 it will cause tension in pull element 8, as effectively the length of pull element 8 needs to increase to accommodate the hinging of elongate member 6. As it is highly undesirable for pull element 8 to have any ability to stretch, as this could allow an undesirable gap to form between it and the elongate member 6 and thus present a choking hazard, instead the elongate member 6 is allowed to slide in sleeve 25 urging against spring 28 (partially shown through openings 38*a* and *b*). Tension in pull member 6 thus increases when elongate member 6 is pivoted as shown.

Figure 6:
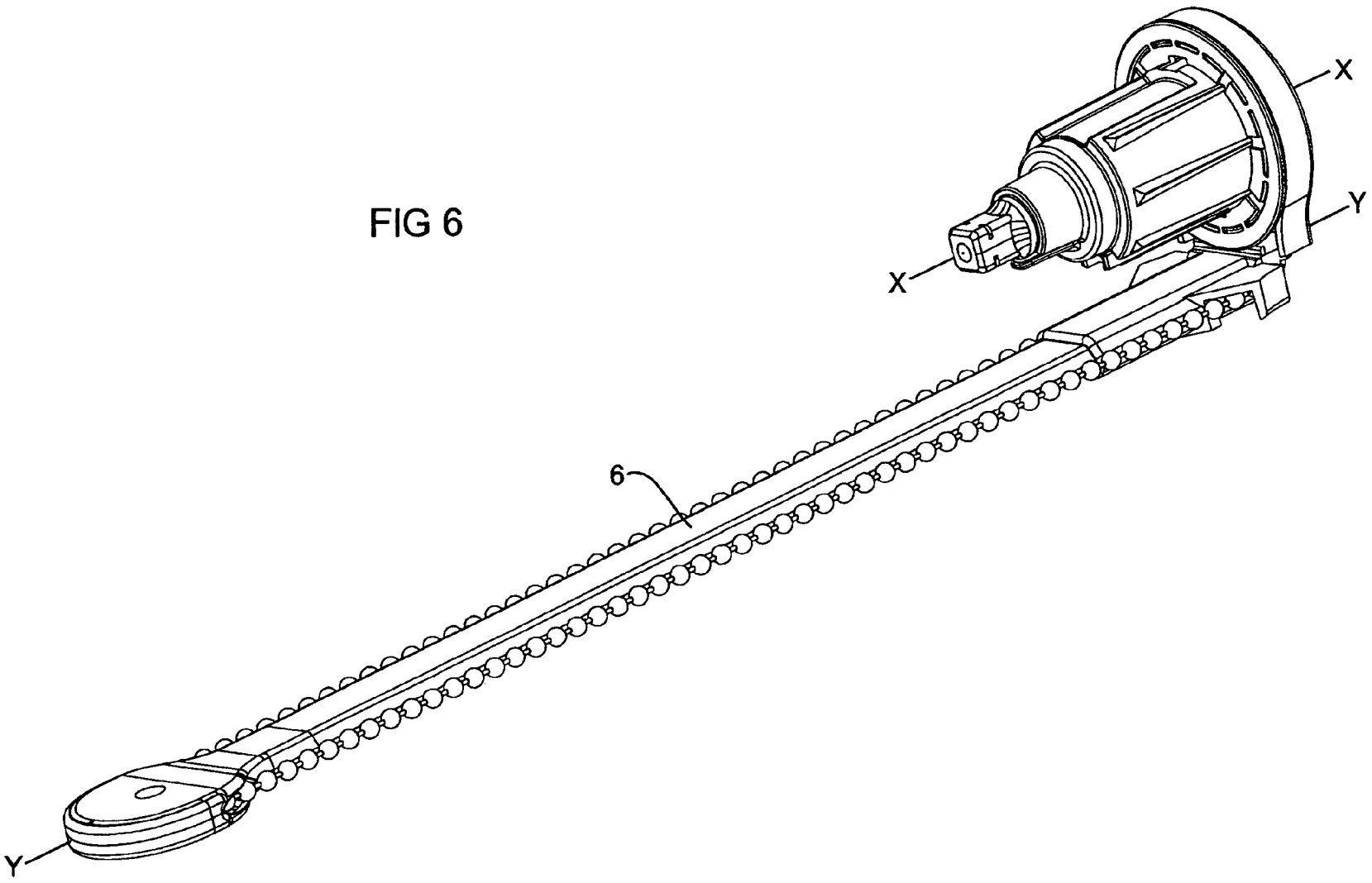
FIG. 6 is an isometric view of the whole of the mechanism of FIG. 5.

In FIG. 6 this pivoted arrangement is shown in overall effect, elongate member 6 having its longitudinal axis YY substantially parallel to axis XX. In actual installation of a blind as would be illustrated in FIG. 1, elongate member 6 may be capable of lying against blind fabric rolled up on a blind cylinder 3, and this ability also means that an assembled blind, clutch and elongate member can be shipped in a convenient collapsed form.

Figure 7:
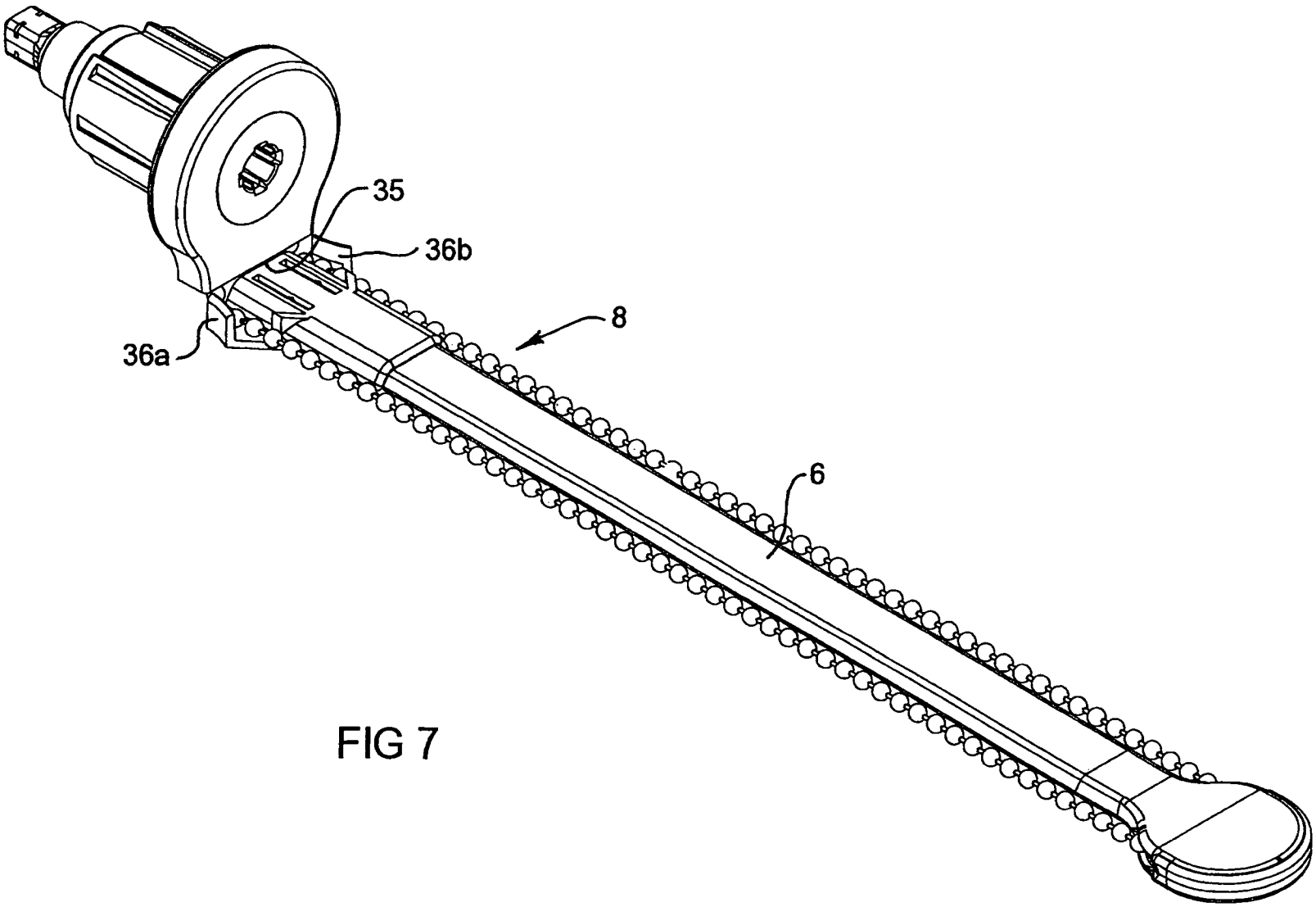
FIG. 7 is an isometric view of the whole of the mechanism of FIG. 5 showing the elongate member in an outwardly folded position.

In FIG. 7 elongate member 6 is shown pivoted about hinge 35 through an arc approaching 90° from the normal operating position in the opposite direction from that shown in FIGS. 5 and 6. Again it is preferable that guides 36*a* and 36*b* contain pull element 8, and preferably the arrangement is such that undue slack is not able to develop in pull element 8 in this arrangement.

According to the present invention, the pull element 8 can thus be exposed for use for the majority of its length while not allowing a dangerous loop to form which could present a choking hazard. If the pull element were substantially enclosed in a conduit, with only a limited portion being exposed to activate a blind, this may be a relatively safe arrangement but would be highly inconvenient when trying to adjust the blind due to the short stroke of pull element that can be drawn at any one time.

Various alterations and/or additions may be introduced to the mechanism as hereinbefore described without departing from the spirit or ambit of the invention.

The claims defining the invention are as follows:

1. A mechanism for controlling adjustment of a blind, the mechanism comprising:

a fixable member which in use is fixed in position relative to the blind, a rotatable member located proximate the fixable member being rotatable relative to the fixable member about an axis of rotation to adjust the blind, an elongate member having a proximal end, a distal end and a longitudinal axis, the proximal end of the elongate member located proximate the rotatable member and the distal end of the elongate member free to move relative to the fixable member in a plane perpendicular to the axis of rotation, a continuous pull element which interacts with the rotatable member, the pull element being movable relative to the fixable member to rotate the rotatable member, the pull element being arranged relative to the elongate member extending from the rotatable member towards the distal end of the elongate member and back towards the rotatable member such that movement of the pull element in a direction substantially perpendicular to the longitudinal axis of the elongate member is limited, biasing means for urging the elongate member away from the fixable member so as to apply tension to the pull element, and a housing which houses the rotatable member, the housing comprising a sleeve to accommodate the proximal end of the elongate member so as to allow the elongate member to be linearly movable in a direction perpendicular to the axis of rotation.

2. A mechanism according to claim 1 wherein the pull element is a continuous chain.

3. A mechanism according to claim 1 wherein the rotatable member is a pulley.

4. A mechanism according to claim 1 further comprising a guide located at the distal end of the elongate member around which the pull element passes.

5. A mechanism according to claim 4 wherein the guide is a pulley that rotates as the pull element is moved.

6. A mechanism according to claim 1 further comprising a cylinder for carrying a blind and being rotatable on rotation of the rotatable member.

7. A mechanism according to claim 1 further comprising a driven member interacting with the rotatable member, and a clutch interacting with the fixable member and the driven member, wherein the clutch adopts a disengaged condition when the rotatable member is rotated so as to allow rotation of the driven member and adopts an engaged condition upon cessation of rotation of the rotatable member to prevent further rotation of the driven member.

8. A mechanism according to claim 7 wherein the driven member is mounted on the rotatable member.

9. A mechanism according to claim 7 wherein the rotatable member includes a barrel portion, and the clutch includes at least one helical spring associated with the fixable member, the helical spring being substantially coaxial with the axis of rotation, the helical spring including a protrusion at each end of the helical spring extending radially of the axis of rotation, whereby the protrusions are engaged by the barrel portion to expand the helical spring when adopting the disengaged condition.

10. A mechanism according to claim 9 wherein the driven member includes a rib that engages the protrusion on the helical spring to urge the helical spring to contract when adopting the engaged condition.

11. A mechanism according to claim 10 wherein the at least one helical spring includes two helical springs, whereby the protrusions at one end of each spring are substantially longitudinally aligned, and the protrusions at an opposing end of each spring are also substantially longitudinally aligned.

12. A mechanism for controlling adjustment of a blind, the mechanism comprising:

a fixable member which in use is fixed in position relative to the blind, a rotatable member located proximate the fixable member and being rotatable relative to the fixable member about an axis of rotation to adjust the blind, an elongate member having a proximal end, a distal end and a longitudinal axis, the proximal end of the elongate member located proximate the rotatable member, a housing which houses the rotatable member, the housing including a sleeve to accommodate the proximal end of the elongate member so as to allow the elongate member to be movable in a direction perpendicular to the axis of rotation, a continuous pull element which interacts with the rotatable member, the pull element being movable relative to the fixable member to rotate the rotatable member, the pull element being arranged relative to the elongate member extending from the rotatable member towards a distal end of the elongate member and back towards the rotatable member such that movement of the pull element in a direction substantially perpendicular to the longitudinal axis of the elongate member is limited, and biasing means for urging the elongate member away from the fixable member so as to apply tension to the pull element, wherein the housing includes an abutment against which the biasing means abuts, and the proximal end of the elongate member also abuts against the abutment to limit movement of the elongate member towards the axis of rotation.

13. A mechanism according to claim 12 wherein the biasing means is a compression spring.

14. A mechanism according to claim 13 wherein the elongate member is capable of pivoting relative to the housing in a plane in which the axis of rotation lies.

15. A mechanism according to claim 14 wherein pivoting of the elongate member increases the tension in the pull element.

* * * * *